US005645496A

United States Patent [19]

Endo et al.

[11] Patent Number: 5,645,496

[45] Date of Patent: Jul. 8, 1997

[54] TWO-PIECE GOLF BALL

[75] Inventors: Seiichiro Endo, Akashi; Kuniyasu Horiuchi, Kobe, both of Japan

[73] Assignee: Sumitomo Rubber Industries, Ltd., Hyogo-ken, Japan

[21] Appl. No.: 365,537

[22] Filed: Dec. 28, 1994

[30] Foreign Application Priority Data

Dec. 28, 1993 [JP] Japan ..... 5-353772

[51] Int. Cl.[6] ..... A63B 37/06

[52] U.S. Cl. ..... 473/372; 473/377; 473/351

[58] Field of Search ..... 273/230, 235 R; 473/372, 377, 351

[56] References Cited

U.S. PATENT DOCUMENTS

| | | | |
|---|---|---|---|
| 4,714,253 | 12/1987 | Nakahara et al. | 273/230 X |
| 4,781,383 | 11/1988 | Kamada et al. | 273/230 X |
| 4,858,924 | 8/1989 | Saito et al. | 273/230 X |
| 4,919,434 | 4/1990 | Saito | 273/235 R |
| 5,304,608 | 4/1994 | Yabuki et al. | 473/372 X |

FOREIGN PATENT DOCUMENTS

| | | |
|---|---|---|
| 0545541 | 6/1993 | European Pat. Off. . |
| 0568332 | 11/1993 | European Pat. Off. . |
| 2127303 | 4/1984 | United Kingdom . |
| 2232162 | 12/1990 | United Kingdom . |

*Primary Examiner*—George J. Marlo

*Attorney, Agent, or Firm*—Birch, Stewart, Kolasch & Birch, LLP

[57] ABSTRACT

A two-piece golf ball which consists essentially of a core and a cover covering the core, wherein said core is made of a rubber composition comprising 100 parts by weight of a base rubber, 20 to 45 parts by weight of a co-crosslinking agent and 0.3 to 5.0 parts by weight of an organic peroxide, a hardness of the core is within a range of 40 to 56 in the vicinity of its center and 70 to 95 in the vicinity of its surface; a difference between a hardness in the vicinity of the surface and that in the vicinity of the center is within a range of 20 to 40; and a compression deformation amount formed between initial loading 10 kg and final loading 130 kg is 3.1 to 4.5 mm; said hardness being measured by means of JIS-C type hardness tester.

7 Claims, 1 Drawing Sheet

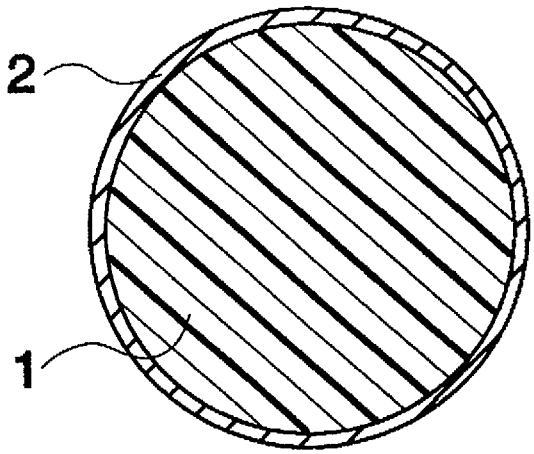
2
1

TWO-PIECE GOLF BALL

FIELD OF THE INVENTION

The present invention relates to a two-piece golf ball. More particularly, it relates to a two-piece golf ball which is superior in hit feeling and in attaining high a launch angle.

BACKGROUND OF THE INVENTION

A two-piece golf ball has been widely been used by a lot of golfers, e.g. amateur golfers and professional golfers, because of its long flying distance and excellent flying performance. However, its hit feeling is hard in comparison with a conventional thread-wound golf ball and thus this is an area for improvement.

Heretofore, much effort has been made in order to make hit feeling of the two-piece golf ball soft, that is, to make hit feeling similar to that of a thread-wound golf ball. For example, the cover of the golf ball has been softened or the core has been softened.

However, it is hard to say that a hit feeling which is similar to that of a thread-wound golf ball can be obtained by means of conventional techniques. Further, there is also the drawback that the two-piece golf ball is hard to stop using a short iron in comparison with the thread-wound golf ball.

OBJECTS OF THE INVENTION

The main object of the present invention is to provide a two-piece golf ball having excellent control properties, which is easily flown and easily stopped by a short iron, by making the hit feeling of the two-piece golf ball similar to that of the thread-wound golf ball and increasing the launch angle.

This object as well as other objects and advantages of the present invention will become apparent to those skilled in the art from the following description.

SUMMARY OF THE INVENTION

In the present invention, characteristics of the two-piece golf ball such as hardness of the core are controlled to make hit feeling similar to that of the thread-wound golf ball and, at the same time, a golf ball which is easily made airborne is provided. That is, the present invention provides a two-piece golf ball comprising a core 1 and a cover 2 covering the core, wherein said core is made of a rubber composition comprising 100 parts by weight of a base rubber, 20 to 45 parts by weight of a cocrosslinking agent and 0.3 to 5.0 parts by weight of an organic peroxide, a hardness of the core within a range of 40 to 57 in the vicinity of its center and 70 to 95 in the vicinity of its surface; a difference between the hardness in the vicinity of the surface and that in the vicinity of the center being within a range of 20 to 40; and a compression deformation amount formed between initial loading 10 kg and final loading 130 kg is g 3.0 to 4.8 mm; said hardness being measured by means of JIS-C type hardness tester.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

The single FIGURE represents the two-piece golf ball of the present invention.

DETAILED DESCRIPTION OF THE INVENTION

The core 1 of the golf ball of the present invention is made of a rubber composition comprising a base rubber, a cocrosslinking agent and an organic peroxide.

As the base rubber in the present invention, there can be used a natural rubber and/or synthetic rubber which have hitherto been used for a two-piece core. Particularly, cis-1, 4-polybutadiene rubber having at least 40% of a cis-structure is preferred. If necessary, natural rubber, styrene-butadiene rubber, EPDM, etc. may be suitably formulated in the polybutadiene rubber.

The cocrosslinking agent may be specifically limited and examples thereof include metals salts of unsaturated carboxylic acids, particularly monohydric or dihydric metal salts of unsaturated carboxylic acids having 3 to 8 carbon atoms (e.g. acrylic acid, methacrylic acid, etc.). Among them, zinc acrylate is particularly preferred. The amount of the cocrosslinking agent is 20 to 45 pads by weight based on 100 parts by weight of the base rubber. When the amount is smaller than 20 parts by weight, the hardness of the golf ball is insufficient, which results in excessively heavy and inferior feeling. Further, the durability also is inferior. On the other hand, when it exceeds 45 parts by weight, it is too hard, which results in inferior feeling.

Examples of the organic peroxide include dicumyl peroxide, di-t-butyl peroxide and the like. Among them, dicumyl peroxide is particularly preferred. The amount is 0.3 to 5.0 parts by weight, preferably 0.5 to 3.0 parts by weight, based on 100 parts by weight of the base rubber. When the amount is smaller than 0.3 parts by weight, the hardness of the golf ball is insufficient, which results in a heavy and inferior feeling. On the other hand, when the amount exceeds 5.0 pads by weight, it becomes too hard, which results in an inferior feeling.

If necessary, additives such as fillers, antioxidants, etc. may be formulated in the rubber composition used for the golf ball of the present invention. Representative examples of the filler include zinc oxide, barium sulfate, etc. and the amount thereof varies depending on the specific gravity and size of the cover 2 and core 1, and is not specifically limited. Normally, it is 10 to 40 parts by weight based on 100 pads by weight of the base rubber.

According to the present invention, the core of the two-piece golf ball can be formed by kneading the rubber composition sufficiently, followed by vulcanization molding in a die. It is preferred that the hardness of the core of the present invention (measured by JIS-C type hardness tester) is within a range of 40 to 57 in the vicinity of the center and 70 to 95 in the vicinity of the surface (within 3 mm away from the surface) and, further, the difference in hardness in the vicinity of the surface and that in the vicinity of the center is within a range of 20 to 40. When the hardness of the core in the vicinity of the center is smaller than 40, the durability is inferior and it is too soft and the hit feeling becomes heavy, which results in an inferior feeling. When it exceeds 57, the hit feeling becomes hard, which results in an inferior feeling. When the hardness of the core in the vicinity of the surface is smaller than 70, the hit feeling becomes heavy, which results in an inferior feeling. On the other hand, when it exceeds 95, the hit feeling becomes hard. Further, if the difference in hardness in the vicinity of the surface and that in the vicinity of the center is smaller than 20, the launch angle is small and it becomes difficult to fly the golf ball. On the other hand, when it exceeds 40, the durability becomes inferior.

Further, regarding the core used for the two-piece golf ball of the present invention, it is necessary that the compression deformation amount formed between initial loading (10 kg) and final loading (130 kg) is 3.0 to 4.8 mm, preferably 3.1 to 4.5 mm. When the compression deformation amount is smaller than 3.0 mm, the hit feeling is hard, which results in an inferior feeling. On the other hand, when it exceeds 4.8 mm, it is too soft, which results in heavy feeling. Further, the golf ball can not be flown.

Persons skilled in the art can mold the core so as to satisfy the above essential elements, by controlling the vulcanization condition. For example, it is conducted by setting a vulcanization temperature so that the vulcanization peak may be obtained within 5 to 20 minutes from the vulcanization initiation time, i.e. the time when a die is closed being taken as the vulcanization initiation time. The vulcanization reaction is conducted for 20 to 50 minutes from the vulcanization initiation time. The vulcanization temperature is normally 130° to 180° C. By controlling the temperature within this range, the above hardness condition and condition of compression deformation can be satisfied.

A two-piece golf ball can be obtained by covering the core thus obtained with a cover.

The cover is formed by covering the core with a cover material obtained by suitably formulating inorganic oxides such as titanium oxide ($TiO_2$), etc. into a resin component which is mainly composed of an ionomer resin, if necessary.

When the core is covered with the above cover, an injection molding method is normally used, but not specifically limited thereto. Further, when the resin component of the cover, which is mainly composed of an ionomer resin, is prepared, the ionomer resin may be used alone as the resin component, or resins such as polyethylene, polyamide, etc. or rubbers may be suitably formulated into the ionomer resin as the main component.

The thickness of the cover is not specifically limited, but it is normally 1.4 to 2.7 mm. In case of cover molding, a dimple may be formed, if necessary. Further, if necessary, a paint or marking may be applied after the cover molding.

As described above, according to the present invention, it is possible to make the hit feeling of the golf ball softer by increasing the difference between the surface hardness of the core and center hardness. Also, there can be obtained a large launch angle at the time of hitting whereby the golf ball can be easily flown and easily stopped when using the short irons.

EXAMPLES

The following Examples and Comparative Examples further illustrate the present invention in detail but are not to be construed to limit the scope thereof.

Examples 1 to 5 and Comparative Examples 1 to 5

The components of the core formulation shown in Tables 1 and 2 were kneaded to prepare a rubber composition, which was subjected to a vulcanization molding in a die under the vulcanizing condition shown in Tables 1 and 2 to give a core, respectively. The hardness was measured at the center of the core, locations which are respectively 5 mm, 10 mm and 15 mm away from the center and the surface of the core, using a JIS-C type hardness tester. Further, the compression strength of the core was also measured.

The core thus obtained was coated with an ionomer resin of the cover formulation shown in Tables 1 and 2 by an injection molding. The stiffness and the thickness of the cover were shown in Tables 1 and 2.

Further, all "parts" in Tables 1 and 2 are by weight. "BR-01" in the core formulation is a butadiene rubber having a cis-1,4-content of (96%) manufactured by Japan Synthetic Rubber Co., Ltd. Further, "Hi-milane 1605" and "Hi-milane 1706" are ionomer resins commercially available from Mitsui Polychemical Co., Ltd.

TABLE 1

| | | | Exmple No. | | | | |
|---|---|---|---|---|---|---|---|
| | | | 1 | 2 | 3 | 4 | 5 |
| Core | Formulation | BR-01 | 100 | 100 | 100 | 100 | 100 |
| | | Zinc diacrylate | 22 | 30 | 35 | 30 | 38 |
| | | Zinc Oxide | 24 | 19 | 18 | 19 | 17.5 |
| | | Antioxidant | 0.5 | 0.5 | 0.5 | 0.5 | 0.5 |
| | | Dicumyl peroxide | 2.0 | 0.2 | 0.8 | 1.2 | 0.7 |
| | Vulcanizing condition | | 165° C. × 25 min | 165° C. × 25 min | 160° C. × 30 min | 175° C. × 23 min | 175° C. × 30 min |
| | Hardness distribution | Center | 48 | 52 | 56 | 44 | 55 |
| | | Location which is 5 mm away from the center | 62 | 68 | 70 | 61 | 70 |
| | | Location which is 10 mm away from the center | 66 | 72 | 74 | 66 | 75 |
| | | Location which is 15 mm away from the center | 74 | 78 | 82 | 75 | 84 |
| | | Surface | 76 | 81 | 85 | 78 | 87 |
| | Compression strength | (mm) | 4.50 | 3.70 | 3.30 | 3.90 | 3.10 |
| Cover | Formulation | Hi-milane 1605 | 50 | 50 | 50 | 50 | 50 |
| | | Hi-milane 1706 | 50 | 50 | 50 | 50 | 50 |
| | Stifness | Kgf/cm$^2$ | 3300 | 3300 | 3300 | 3300 | 3300 |
| | Cover thickness | mm | 1.6 | 1.6 | 1.6 | 1.6 | 1.6 |

TABLE 2

| | | | Comparative Example No. | | | | |
|---|---|---|---|---|---|---|---|
| | | | 1 | 2 | 3 | 4 | 5 |
| Core | Formulation | BR-01 | 100 | 100 | 100 | 100 | 100 |
| | | Zinc diacrylate | 30 | 35 | 30 | 38 | 18 |
| | | Zinc Oxide | 19 | 18 | 19 | 17.5 | 27 |
| | | Antioxidant | 0.5 | 0.5 | 0.5 | 0.5 | 0.5 |
| | | Dicumyl peroxide | 1.2 | 2.0 | 2.0 | 1.2 | 2.2 |
| | Vulcanizing condition | | 140° C. × 25 min + 165° C. × 8 min | 163° C. × 25 min | 150° C. × 35 min | 160° C. × 30 min | 165° C. × 30 min |
| | Hardness distribution | Center | 74 | 70 | 69 | 73 | 38 |
| | | Location which is 5 mm away from the center | 75 | 73 | 75 | 76 | 54 |
| | | Location which is 10 mm away from the center | 77 | 77 | 77 | 78 | 58 |
| | | Location which is 15 mm | 78 | 78 | 80 | 84 | 65 |
| | | away from the center | 79 | 80 | 82 | 88 | 69 |
| | | Surface | | | | | |
| | Compression strength | (mm) | 2.95 | 3.05 | 2.90 | 2.80 | 5.00 |
| Cover | Formulation | Hi-milane 1605 | 50 | 50 | 50 | 50 | 50 |
| | | Hi-milane 1706 | 50 | 50 | 50 | 50 | 50 |
| | Stifness | Kgf/cm$^2$ | 3000 | 3000 | 3000 | 3000 | 3000 |
| | Cover thickness | mm | 1.6 | 1.6 | 1.6 | 1.6 | 1.6 |

The evaluation of the resulting golf ball was conducted. The hardness (PGA indication) and the durability index as well as the flying distance, the launch angle and the hit feeling (evaluation of feeling) obtained by hitting with respective clubs were evaluated. The durability index was measured as follows. That is, a golf ball was hit repeatedly at a head speed of 45 m/second using a swing robot manufactured by True Temper Co. and the number of times until breakage, cracking, etc. is generated was measured and, further, the resulting value was indicated as an index in case of the value of the golf ball of Example 2 being 100. The flying distance and the launch angle were measured by hitting a golf ball using a commercially available swing robot manufactured by True Temper Co. equipped with a No. 1 wood club, No. 5 iron club and No. 9 iron club. The feeling was determined by 20 top professional golfers. The evaluation results of the golf bails of the above Examples and Comparative Examples are shown in Tables 3 and 4.

TABLE 3

| | | | Example No. | | | | |
|---|---|---|---|---|---|---|---|
| | | | 1 | 2 | 3 | 4 | 5 |
| Evaluation of ball | Hardness (PGA indication) | | 88 | 95 | 100 | 93 | 103 |
| | Durability index | | 85 | 100 | 115 | 95 | 125 |
| | No. 1 wood club 45 m/s | Carry | 235 | 237 | 238 | 237 | 240 |
| | | Total | 249 | 248 | 251 | 248 | 249 |
| | No. 5 iron club 38 m/s | Launch angle | 15.0° | 14.8° | 14.7° | 15.0° | 14.5° |
| | | Carry | 192 | 191.5 | 190.5 | 192 | 190.5 |
| | No. 9 iron club 34 m/s | Launch angle | 28.0° | 27.8° | 27.6° | 28.1° | 27.5° |
| | | Carry | 128.5 | 128.0 | 127.5 | 129 | 127.5 |
| | | Total | 129.0 | 128.5 | 128.5 | 129.5 | 128.5 |
| | Evaluation of feeling | | Soft | Soft | Soft | Soft | Soft |
| | | | | Good resilience | Good resilience | Good resilience | Good resilience |
| | | | Golf ball is easily flown | Golf ball is easily flown | Golf ball is easily flown | Golf ball is easily flown | Golf ball is easily flown |
| | | | It is easily stopped by short iron | It is easily stopped by short iron | It is easily stopped by short iron | It is easily stopped by short iron | It is easily stopped by short iron |

TABLE 4

| | | | Comparative Example No. | | | | |
|---|---|---|---|---|---|---|---|
| | | | 1 | 2 | 3 | 4 | 5 |
| Evaluation of ball | Hardness (PGA indication) | | 104 | 103 | 106 | 108 | 80 |
| | Durability index | | 125 | 130 | 130 | 160 | 60 |
| | No. 1 wood club 45 m/s | Carry | 231 | 231 | 232 | 232 | 229 |

TABLE 4-continued

| | | Comparative Example No. | | | | |
|---|---|---|---|---|---|---|
| | | 1 | 2 | 3 | 4 | 5 |
| | Total | 241 | 243 | 241 | 245 | 244 |
| No. 5 iron club 38 m/s | Launch angle | 14.2° | 14.2° | 14.3° | 14.3° | 15.2° |
| | Carry | 187.5 | 187.5 | 188 | 188.5 | 189.0 |
| No. 9 iron club 34 m/s | Launch angle | 27.2° | 27.3° | 27.0° | 26.9° | 28.2° |
| | Carry | 126.5 | 126.5 | 125.5 | 125.0 | 127.0 |
| | Total | 128.5 | 128.5 | 128.0 | 127.5 | 127.5 |
| Evaluation of feeling | | Hard and heavy | Hard | Hard | Hard | Heavy Inferior resilience |
| | | Golf ball is not flown It is hardly stopped by short iron | Golf ball is not flown It is hardly stopped by short iron | Golf ball is not flown It is hardly stopped by short iron | Golf ball is not flown It is hardly stopped by short iron | Golf ball is easily to be flown It is easily stopped by short iron |

As is apparent from the above results, all golf balls obtained in the present invention have a soft feeling and a feeling that the golf ball is easily flown. On the other hand, all golf balls shown in the Comparative Examples have a hard feeling and a feeling that the golf ball is hardly flown.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A two-piece golf ball which consists essentially of a core and a cover covering the core, wherein said core is made of a rubber composition comprising 100 parts by weight of a base rubber, 20 to 45 parts by weight of a co-crosslink agent and 0.3 to 5.0 parts by weight of an organic peroxide, a hardness of the core is within a range of 40 to 56 in the vicinity of its center and 70 to 95 in the vicinity of its surface; a difference between a hardness in the vicinity of the surface and that in the vicinity of the center is within a range of 20 to 40; and a compression deformation amount formed between initial loading 10 kg and final loading 130 kg is 3.1 to 4.5 mm; said hardness being measured by means of JIS-C type hardness tester.

2. The two-piece golf ball according to claim 1 wherein said base rubber is a natural rubber and/or synthetic rubber.

3. The two-piece golf ball according to claim 1 wherein said base rubber is cis-1,4-polybutadiene rubber having at least 40% of cis-structure.

4. The two-piece golf ball according to claim 1 wherein said cocrosslinking agent includes metals salts of unsaturated carboxylic acids, particularly monohydric or dihydric metal salts of unsaturated carboxylic acids having 3 to 8 carbon atoms.

5. The two-piece golf ball according to claim 1 wherein said organic peroxide is selected from the group consisting of dicumyl peroxide, di-t-butyl peroxide and a mixture thereof.

6. The two-piece golf ball according to claim 1 wherein said rubber composition contains fillers and antioxidants.

7. The two-piece golf ball of claim 1 wherein the co-crosslinking agent is zinc acrylate.

* * * * *